US005148182A

United States Patent [19]

Gautier et al.

[11] Patent Number: 5,148,182

[45] Date of Patent: Sep. 15, 1992

[54] PHASED REFLECTOR ARRAY AND AN ANTENNA INCLUDING SUCH AN ARRAY

[75] Inventors: François Gautier, St. Germain en Laye; Yves Commault, Paris, both of France

[73] Assignee: Thomson-CSF, Paris, France

[21] Appl. No.: 566,546

[22] Filed: Aug. 13, 1990

Related U.S. Application Data

[63] Continuation of Ser. No. 24,323, Mar. 10, 1987, abandoned.

[30] Foreign Application Priority Data

Mar. 14, 1986 [FR] France ..... 86 03648

[51] Int. Cl.[5] ..... H01Q 21/12

[52] U.S. Cl. ..... 343/754; 343/701; 343/755; 343/815; 343/846

[58] Field of Search ..... 343/701, 753, 754, 701, 343/755, 802, 909, 812–815, 846; 342/373, 374

[56] References Cited

U.S. PATENT DOCUMENTS

| | | | |
|---|---|---|---|
| 3,045,237 | 7/1962 | Marston | 343/909 |
| 3,274,601 | 9/1966 | Blass | 342/373 |
| 3,276,023 | 9/1966 | Dorne et al. | 343/754 |
| 3,392,393 | 7/1968 | Spitz | 343/909 |
| 3,456,260 | 7/1969 | Hannan | 343/755 |
| 3,852,755 | 12/1974 | Works et al. | 343/701 |
| 3,959,794 | 5/1976 | Chrepta et al. | 343/701 |
| 4,509,209 | 4/1985 | Itoh et al. | 343/700 MS |
| 4,531,126 | 7/1985 | Sadones | 343/751 |
| 4,816,836 | 3/1989 | Lalezari | 343/700 MS |

OTHER PUBLICATIONS

Phelan, "Spiraphase Reflectarray for Multitarget Radar", Microwave Journal, Jul. 1977, pp. 67, 68, 70 and 73.

*Primary Examiner*—Michael C. Wimer
*Attorney, Agent, or Firm*—Roland Plottel

[57] ABSTRACT

The present invention provides phased arrays using monolithic technology of diffusions over whole wafers for working in millimetric wave frequency bands. The reflector array includes a plurality of metallizations connected together by diodes whose capacity can be varied. Thus direct control of reactive impedances is obtained. With the metallized strips placed at a distance substantially equal to λ/4 from a ground plane, it is possible to control locally the phase of the reflected signal.

14 Claims, 6 Drawing Sheets

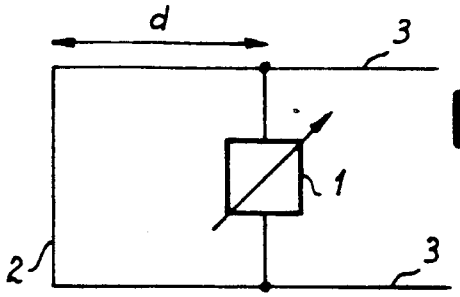
FIG_1
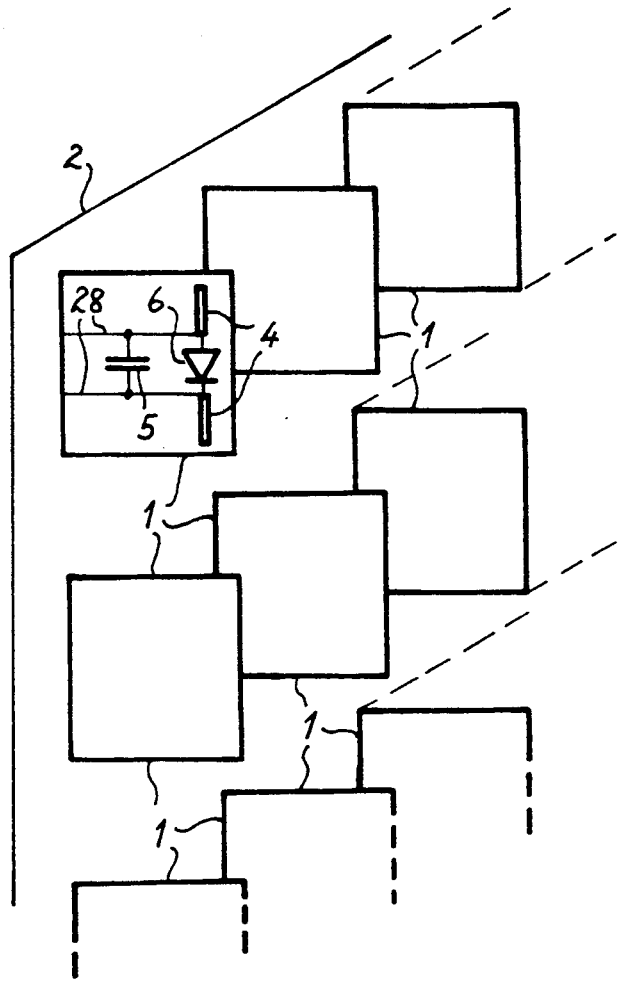
FIG_2
FIG_3
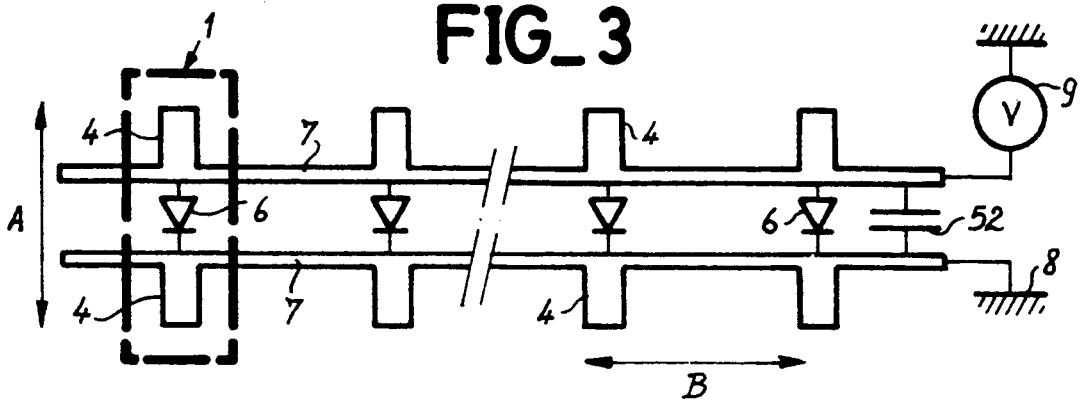

PHASED REFLECTOR ARRAY AND AN ANTENNA INCLUDING SUCH AN ARRAY

This application is a continuation of application Ser. No. 07/024,323, filed Mar. 10, 1987 now abandoned.

BACKGROUND OF THE INVENTION

1. Field of the Invention

The purpose of the invention is principally to provide a phased reflector array and an antenna including such an array.

With such an array, the phase of a wave, for example plane or cylindrical reflected on itself, may be locally modified. With such an array the electromagnetic energy beams of an electronic scan antenna may be focused and/or deflected.

2. Description of the Prior Art

Reflectors are already known, generally plane, and forms a mosaic or array of modules. Each module includes an elementary antenna and a phase shifter closed on a short circuit. A wave, whose beam it is desired to direct, is transmitted by an ultra-high frequency source in the direction of the array. The wave is picked up by the elementary antennae and undergoes a first phase shift on passing through the phase shifters, is reflected from the short circuits, passes again through the phase shifters and is radiated by the elementary antennae. By controlling, using electronic means, the phase shift provided by the phase shifters, the phase of the transmitted wave may be controlled at any point in the array. Such arrays are described by F. GAUTIER in "Réseau réflecteur" TH-CSF Revue March 1972, vol. 4, no. 1, pages 89–104 and by Oliver and Knittel in "Phased arrays antennae" Artech house, page 23.

Furthermore, it is known that the variation of the reactive impedance for example of a dipole placed in front of a metal reflector causes variation of the phase of the reflected wave.

Known arrays have the great drawback of requiring perfect or substantially perfect matching of the elementary antennae. In fact, on reception by the array any mismatching causes the partial reflection of a part of the incident energy instead of its transmission, the phase of the directly reflected energy is not controlled by the phase shifter. On emission by the array, any mismatching causes reflection towards the phase shifter of the energy which would normally be transmitted, this energy therefore undergoes twice the double passage through the phase shifter. At the time of transmission, the waves not having the desired phase shift, disturb the formation of the energy beam. Now, it has proved very difficult in practice to provide precise and uniform matching of all the elementary sources of the array.

In addition, it is not possible in practice to construct a phase shift module array capable of working in the millimetric bands. For these bands, the modules must have small dimensions, less than the wave length; the array must include a very large number of them.

SUMMARY OF THE INVENTION

The invention consists in associating a plurality of variable reactive impedances in front of a reflector, for example made from metal, so as to be able to obtain an electronic sweep.

Advantageously, the dipoles are placed at a distance close to $\lambda/4$, $\lambda$ being the wave length of the radiation used.

Advantageously, the phase control of the reactive impedance includes at least four distinct states. For example, the induced phase shifts correspond to 0,90°, 180° and 270°.

Advantageously, the reactive impedances are dipoles having two legs connected together by at least one diode. Depending on the enabled or disabled state of the diodes, the dipoles reflect a larger or smaller part of the incident waves.

The invention provides mainly an active electromagnetic wave reflector having a plurality of controllable variable reactive inductances, wherein each variable reactance includes a plurality of metallizations deposited on a substrate connected together by variable capacity or switching diodes (PIN), said metallizations being placed for example at a distance substantially equal to $\lambda/4$ from a ground plane, $\lambda$ being the wave length of said electromagnetic waves.

The invention also provides an antenna including a primary radiation source illuminating an active reflector wherein said primary source is capable of radiating a cylindrical wave and the active reflector includes a plurality of metallizations connected together by variable capacity diodes, said metallizations being placed at a distance substantially equal to $\lambda/4$ from a ground plane, $\lambda$ being the wave length of said waves.

The present invention also provides an antenna having a primary radiation source illuminating an active reflector, and further including a dielectric lens for focusing said radiation and the active reflector has a plurality of metallizations connected together by variable capacity diodes, said metallizations being placed at a distance substantially equal to $\lambda/4$ from a ground plane, $\lambda$ being the wave length of said radiation.

The present invention also provides a method of manufacturing an active electromagnetic wave reflector, including the following steps:

diffusion of variable capacity diodes in a semiconductor material substrate;

metallization of strips on said semiconductor material substrate;

securing of the semiconductor material substrate to a ground plane so that the metallized strips are at a distance substantially equal to $\lambda/4$ from the ground plane.

The present invention also provides an antenna including a radiation source and a main mirror, including a phased array capable of varying the position of the focus of said main mirror.

BRIEF DESCRIPTION OF THE DRAWINGS

The invention will be better understood from the following description with reference to the FIGS. given as non limitative examples, in which:

FIG. 1 is a diagram of the principle used in the device of the invention;

FIG. 2 is an illustration of one embodiment using the principle illustrated in FIG. 1;

FIG. 3 is an illustration of the first embodiment of the device of the invention;

In FIGS. 1 to 21 the same references have been used to designate the same elements.

DESCRIPTION OF THE PREFERRED EMBODIMENTS

Figure 14:
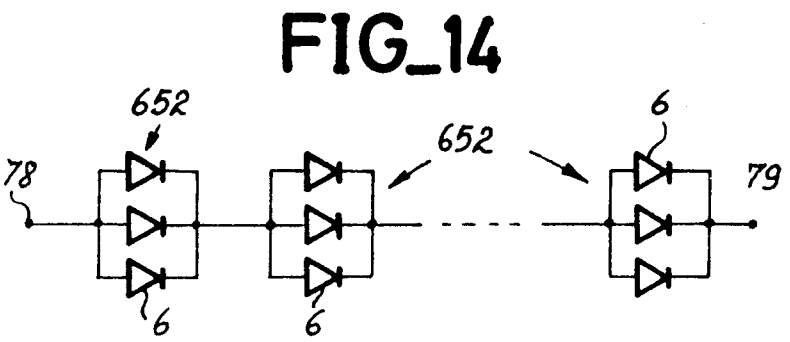
FIG. 14 is an equivalent diagram of the power supply for the diodes of the device illustrated in FIG. 13.

In FIG. 1 is illustrated one of the principles used in a device in accordance with the invention. Across the two supply wires 3 is placed a variable reactive impedance 1 at a distance d from a short circuit 2. If the value of the reactive impedance 1 corresponds to a short circuit for an incident signal, this signal will be reflected from said reactive impedance 1. On the other hand, if the reactive impedance 1 is matched to the signal, it will let it pass. The signal will then be reflected at the short circuit 2. Thus, there exists a phase shift $\phi=$ $$\frac{2\pi d}{\lambda}$$

between the signal reflected by the reactive impedance 1 and the signal reflected by the short circuit 2. Depending on the setting value of the reactive impedance 1, it reflects a larger or smaller part of the incident signal. The signals reflected by the reactive impedance 1 and the short circuit 2 are combined. Thus, the device illustrated in FIG. 1 allows the phase shift $\phi$ to be obtained between 0 and $$\frac{2\pi d}{\lambda}$$

at most, the intermediate values depending on the value of the impedance.

In FIG. 2, a reactive impedance array 1 can be seen placed in front of a reflector 2. The distance separating the reactive impedances 1 from the reflector 2 is substantially equal to $\lambda/4$.

The distance separating two reactive impedances 1, in the plane of the array, is substantially equal to $\lambda/2$ In FIG. 2, only nine reactive impedances 1 have been shown, it being understood that in a real case a much greater number of reactive impedances 1 will be used. Each reactive impedance 1 is formed for example by a dipole 4 whose two legs are joined together by a diode 6. Diode 6 is for example a variable capacity diode.

In a variant of construction of the device of the invention, a plurality of two state diodes are used connected in series between the two legs of a dipole 4. The two state diodes are for example PIN diodes. Each of the diodes is controllable individually. With two diodes having the same capacity per dipole three possible phase shift values are obtained. With two diodes of different capacity four possible phase shift values are obtained. Continuously variable capacity diodes are for example varicaps or varactors.

For the sake of clarity, the power supply connections for diodes 6 have not been shown in FIG. 2.

Reflector 2 is formed by a metal plate placed at a distance close to $\lambda/4$ from the dipoles 4.

Advantageously, the electric lines 28 are joined together by capacitor 5.

The individual control of each of the reactive impedances 1 allows the waves which illuminate the array in accordance with the invention to be deflected both in the elevational of vertical plane and in the horizontal plane.

In FIG. 3, a set of aligned reactances 1 can be seen which can only be controlled simultaneously. The dipoles 4 as well as the connection lines 7 are formed for example by metallization of the printed circuit. The distance B between two successive dipoles 4 is for example of the order of $\lambda/2$. The total length A of a dipole 4 is for example of the order of $\lambda/2$. The two legs of each dipole 4 are joined together by a diode or a plurality of diodes 6.

The supply line 7 connecting together for example the lower legs of dipoles 4 is connected to ground 8. The supply line 7 connecting, for example, the upper legs of dipoles 4 is connected to a voltage source 9. The voltage source 9 is capable of delivering for example voltages varying between +1 V and −20 V.

Advantageously, a capacitor 52 connects together the two supply lines 7 and thus decouples the dipoles 4 from the ultra-high frequency field. This ensures stable impedance conditions at the terminals of the ultra-high frequency circuit. The value of the capacity of this decoupling capacitor is limited, for PIN diodes, by the switching time of the diodes.

Advantageously, reflector 2 is formed by the ground plane of the printed circuit.

Of course, an array formed of the association of devices illustrated in FIG. 3 will only provide scanning and/or focusing of the electromagnetic waves in a single plane.

The embodiment illustrated in FIG. 3 where all the elements of the same line or the same column are supplied together reduces considerably the number of current carrying wires for biasing the diodes 6. Thus the cost price of the complete array is reduced.

Figure 4:
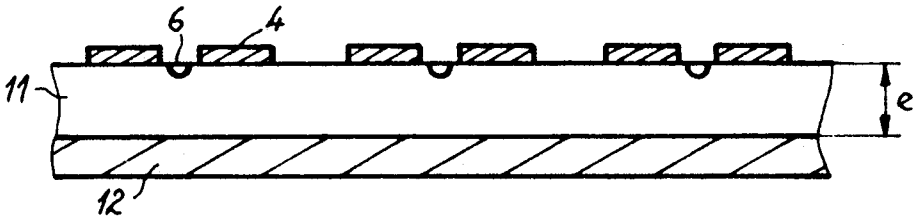
FIG. 4 is a section of a device according to the invention.

In FIG. 4, a variant of construction of the device of the invention can be seen particularly well adapted to electromagnetic waves belonging to the millimetric band.

The coupling elements 4, the control diodes 6 and wiring 7 are formed on the same semiconductor substrate 11 using monolithic integration techniques. A coupling element 4 and one or more diodes 6 which charge it form an electronically controllable reactive element.

Advantageously, these identical reactive agents are disposed in a regular meshed lattice, for example rectangular or triangular, having a pitch close to $\lambda/2$ on a semiconductor substrate 11.

Advantageously, wafer scale integration technology is used. Using large sized wafers for example of four or five inches (10.16 cm or 12.7 cm), it is possible, for $\lambda$ equal for example to 3.2 mm, to obtain in a single operation about a thousand of the reactive element. Such an antenna has the advantage of a reduced cost price. In addition, it would be practically impossible, for such wave lengths, to form electronic sweep antennae using conventional techniques.

On the one hand, the dimensions of the chip carrier of the diode are of the order of 0.5 mm, which for a substrate having a permittivity of the order of 12 corresponds to half of the wave length for a frequency of 100 GHz. Thus the carrier chip of diode 6 is by itself a not inconsiderable element of the circuit. The manufacturing dispersions of this chip and its wiring may make it impossible to construct an antenna using techniques other than monolithic integration techniques.

On the other hand, the carrier chips of the diode 6 are too large for a periodic circuit whose mesh is about 1.5 mm and which, in some cases, includes a plurality of diodes.

Advantageously, the planar technology is used for forming the array of the invention.

The face of substrate 11 opposite the coupling elements 4 and the supply metallizations includes a ground plane 12.

Advantageously, playing the role of reflector to a FIG. 2, the ground plane 12 ensures the mechanical strength and cooling of the array of the invention. If the thickness e of the substrate 11 is too small, for example for frequencies less than 35 GHz, a dielectric is inserted between the ground plane 12 and substrate 11. This solution is shown in FIG. 5.

Figure 5:
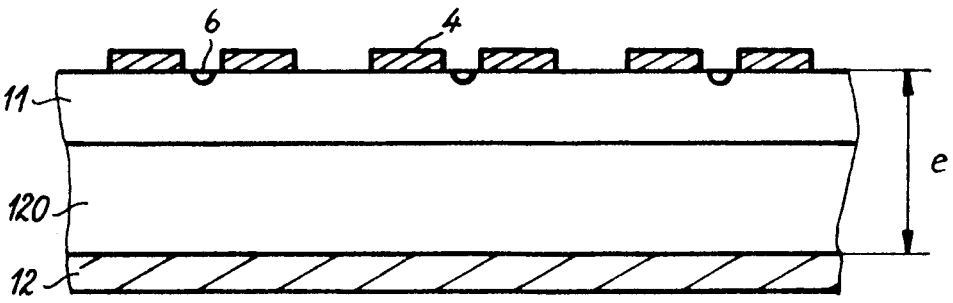
FIG. 5 is a section of a variant of construction of the device of the invention.

In FIG. 5, a part of the phased reflector array can be seen obtained by the diffusion of diode 6 in a semiconductor substrate 11 and metallization of this substrate so as to obtain coupling elements as well as power supply lines for the diode 6. The semiconductor substrate 11 is secured to a dielectric 120, for example a low loss dielectric. Dielectric 120 is for example made from polytetrafluoroethylene (PTFE), or a composite material adapted to the wave length. The dielectric 120 is firmly fixed to a metal plate 12 parallel to the metallizations of substrate 11. The distance e between the metallizations of the semiconductor substrate 11 and plate 12 is substantially equal to a quarter of the wave length balanced on the two dielectrics.

The device shown in FIG. 5 is particularly well adapted to low and medium frequencies.

It should be noted that the cost of the system is only slightly influenced by the number of diodes used or the complexity of the metallization patterns formed.

Different embodiments are shown in FIGS. 6 to 10.

Figure 6:
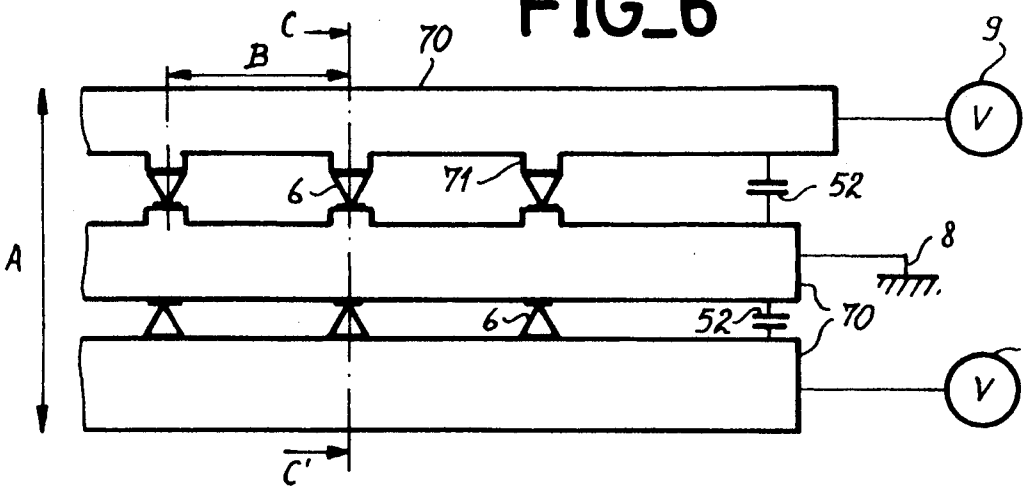
FIG. 6 is a front view of an element of a reflector of the invention.

In FIG. 6, a first embodiment can be seen of a periodic phasing circuit. The device of FIG. 6 includes three metallized strips 70. The middle strip 70 and one of the outside strips 70, for example the upper strip 70, includes facing rectangular projections 71. The facing projections 71 of the two strips 70 are connected together by a diode 6. Vertically in line with diode 6 joining the upper metallized strip 70 to the central metallized strip 70 is provided a diode 6 connecting the lower metallized strip 70 to the central metallized strip 70.

Advantageously, at at least one of the ends the successive strips 70 is joined together by capacitors 52.

In one embodiment of the device of the invention, the central metallized strip 70 is connected to ground, the upper and lower metallized strips 70 being connected to two generators 9. Generators 9 are capable of delivering for example voltages between +1 V and −20 V. The supply voltages depend on the diodes 6 used.

Figure 7:
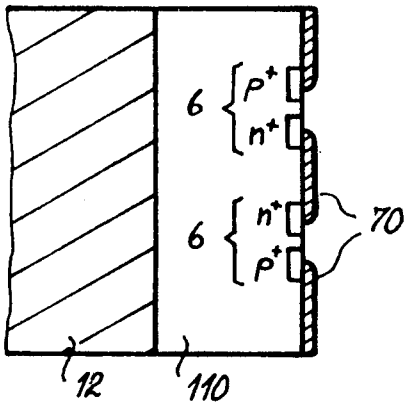
FIG. 7 is a sectional view of a device illustrated in FIG. 6.

In FIG. 7 can be seen a section through CC′ of the device illustrated in FIG. 6 in relation to a planar technology. Diodes 6 are diffused directly from the semiconductor edge 110. The semiconductor is for example silicon.

Advantageously, the ground plane 12 has a sufficient thickness to provide mechanical strength and cooling of the array of the invention. The metallized strips 70 are formed for example by depositing an aluminium or copper layer. Advantageouly, said metallizations 70 are coated with gold coating ensuring protection against corrosion.

Advantageously, strips 70 are formed by deposition of a gold layer.

Figure 8:
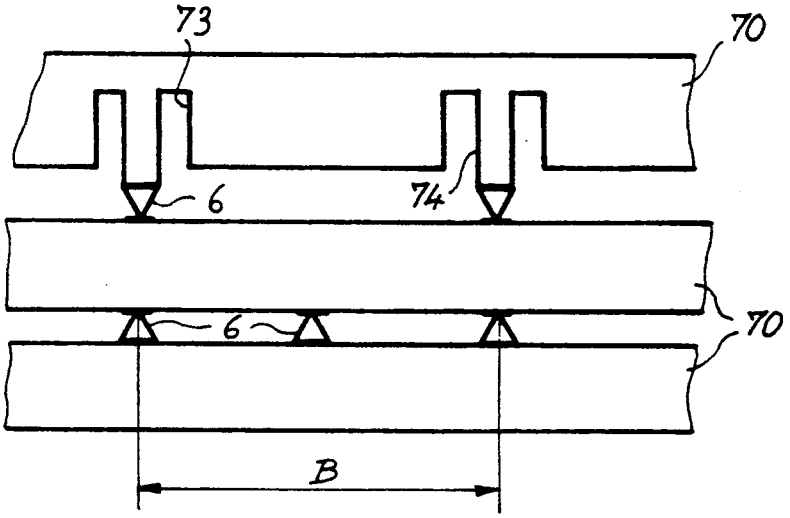
FIG. 8 is a front view of one embodiment of the device of the invention.

In FIG. 8, one embodiment of the device of the invention can be seen including three diodes 6 per periodic circuit mesh. The period B of the array is substantially equal to $\lambda/2$. The lower and central metallized strips 70 are rectilinear ribbons. The upper strip 70 includes rectangular notches 73 with, at their center, rectilinear projections 74. The ends of projections 74 of the upper strip 70 can be the diodes 6 connecting the upper metallized strips 70 to the centralized metallized strips 70. The lower metallized strip 70 is connected to the central metallized strip 70 by evenly spaced diodes 6, two successive diodes 6 being spaced apart by $\lambda/4$. Thus, since each mesh has three diodes 6 it is possible to obtain four different coupling states:

all the diodes at rest or positively biased;

diode 6 connecting the upper metallized strip 70 to the central metallized strip 70 reversely biased, diodes 6 connecting the lower metallized strip 70 to the central metallized strip 70 at rest;

diode 6 connecting the upper metallized strip 70 to the central metallized strip 70 at rest and the two diodes 6 connecting the lower metallized strip 70 to the central metallized strip 70 reversely biased;

all the diodes reversely biased.

In a variant of construction not shown the two diodes 6 connecting the lower metallized strip 70 to the central metallized strip 70 are replaced by a single diode 6 whose capacity is equal, for example, to the sum of the capacity of diode 6 which it replaces. So as to obtain four states, it is imperative that the total capacity in each mesh, connecting the lower metallized strip 70 to the central metallized strip 70 be different from the capacity of the diode 6 connecting the upper metallized strip 70 to the central metallized strip 70.

Of course, the biasing direction of the diodes may be reversed as long as the supply voltages are also reversed. In this case, the lower and upper metallized strip 70 are for example connected to ground, the central metallized strip 70 being connected to a voltage generator capable of delivering voltages between +1 V and −20 V.

Figure 9:
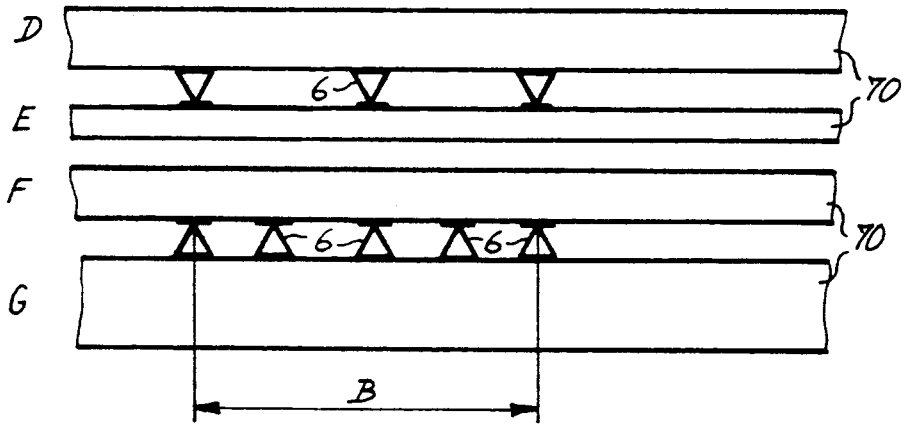
FIG. 9 is one embodiment of the device of the invention.

In FIG. 9, an embodiment is shown of the periodic circuit of the invention including six diodes per mesh B of the array substantially equal to λ/2, which allows four distinct states to be obtained.

In the example illustrated in FIG. 9, the periodic circuits include four metallized strips 70 formed by rectilinear ribbons, referenced from top to bottom D E F G. The metallized ribbon 70D is connected to the metallized ribbon 70E by evenly spaced diodes 6, two successive diodes 6 being spaced apart by λ/4. The metallized strip 70G is connected to the metallized strip 70F by evenly spaced diodes 6, successive diodes 6 being spaced apart by λ/8. The metallized strips 70E and F are connected to ground. The metallized strips 70D and G are connected to voltage generators capable for example of delivering voltages between +1 V and −20 V.

Figure 10:
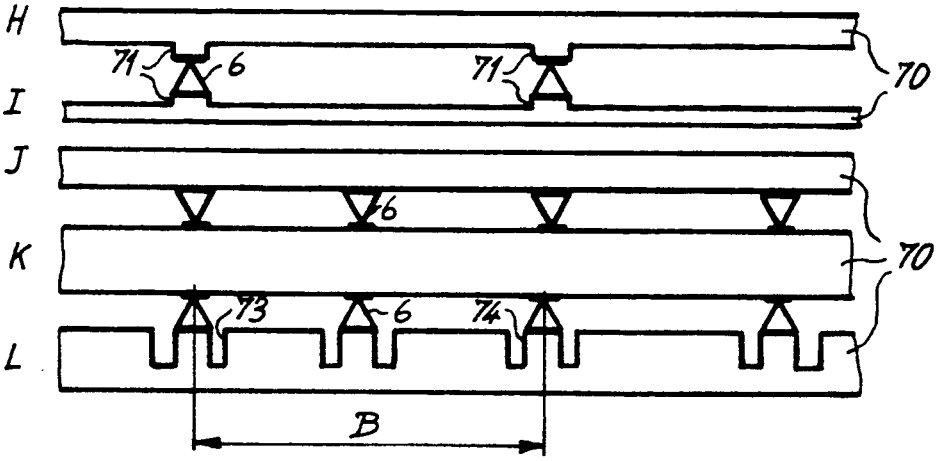
FIG. 10 shows another embodiment of the device of the invention.

In FIG. 10, an embodiment is shown of the periodic arrays of the invention including five diodes 6 per mesh B substantially equal to λ/2. The periodic circuits include five metal strips 70 referenced from top to bottom H I J K L. The metallized strip 70H and the metallized strip 70I are provided with facing projections 71. Projections 71 are spaced apart by λ/2. The metallized strip 70I is connected to the metallized strip 70H by diodes 6 connecting together the projections 71 of said strips. The metallized strips 70J and K are rectilinear ribbons. The metallized strip 70J is connected to the metallized strip 70K by evenly spaced diodes 6, two successive diodes 6 being spaced apart by λ/4. The metallized strip 70L includes notches 73 in the middle of which is disposed a projection 74. The projections 74 are spaced evenly apart, two successive projections 74 being spaced apart by λ/4.

Advantageously, the diodes connecting the metallized strip 70J to the metallized strip 70K and the diodes connecting the metallized strip 70L to the metallized strip 70K are at the same abscissa. Similarly, one projection 74 out of two has the same abscissa as projection 71.

Since coupling with the incident electromagnetic waves for these three diode assemblies is different, $2^3=8$ different states are obtained.

Advantageously, to minimise the phase quantification errors, the different coupling states must be spaced apart as evenly as possible over 360°.

In one embodiment of the device of the invention, using the monolithic integration technology, the cost price is only slightly influenced by the geometry of the strips 70 and the number of diodes 6 used.

It is obvious that it is possible to replace a plurality of individually controllable PIN diodes by a single continuously variable capacity diode. In such a case, it is possible to obtain an infinity of states required for electronic scanning.

Figure 11:
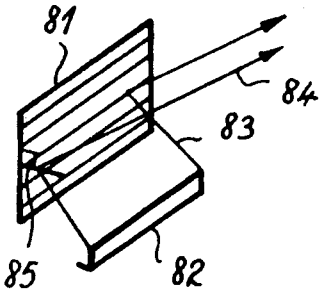
FIG. 11 is a perspective view of a first embodiment of the antenna of the invention.

In FIG. 11, an antenna of the invention can be seen. The antenna includes a phased array 81 providing electronic scanning in a plane. Array 81 is illuminated by a source 82 of radiation 83. The radiation source 82 is for example a linear source or a pinpoint source focused in a plane. In these cases, array 81 is illuminated by cylindrical wave. The phased array 81 reflects the incident waves 83 for example at angles between +45° and −20° with respect to the normal 85 to the ray. In this case, the energy beam 84 may be directed by electronic scanning while ensuring transformation of the cylindrical wave 83 into a plane wave 84.

Figure 12:
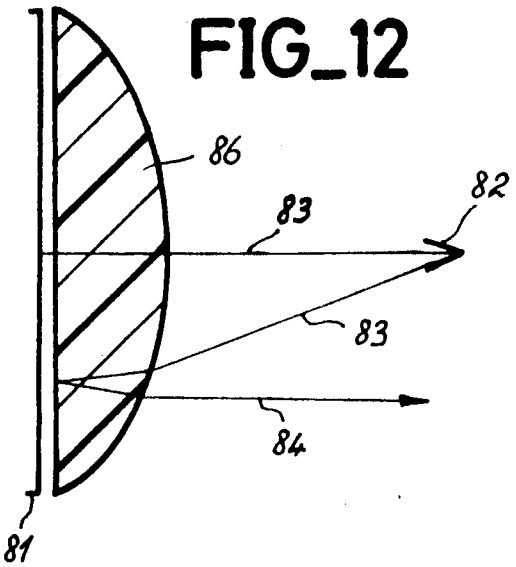
FIG. 12 is a sectional view of a second embodiment of the antenna of the invention.

In FIG. 12, another embodiment of an electronic scan antenna is shown, for example with a sweep frequency of the order of magahertz. The antenna includes a pin point source 82, a reflector array 81 and a lens 86 for example dielectric. In addition to its electronic sweep capacities in a plane, the array is cut up into a plurality of individually supplied zones for example 4, 9 or 16. Thus it provides a three dimensional sweep with low amplitude in one plane and with a high electronic sweep amplitude in the plane which is perpendicular thereto. Lens 86 focuses the radiation 84 coming from the antenna.

Figure 13:
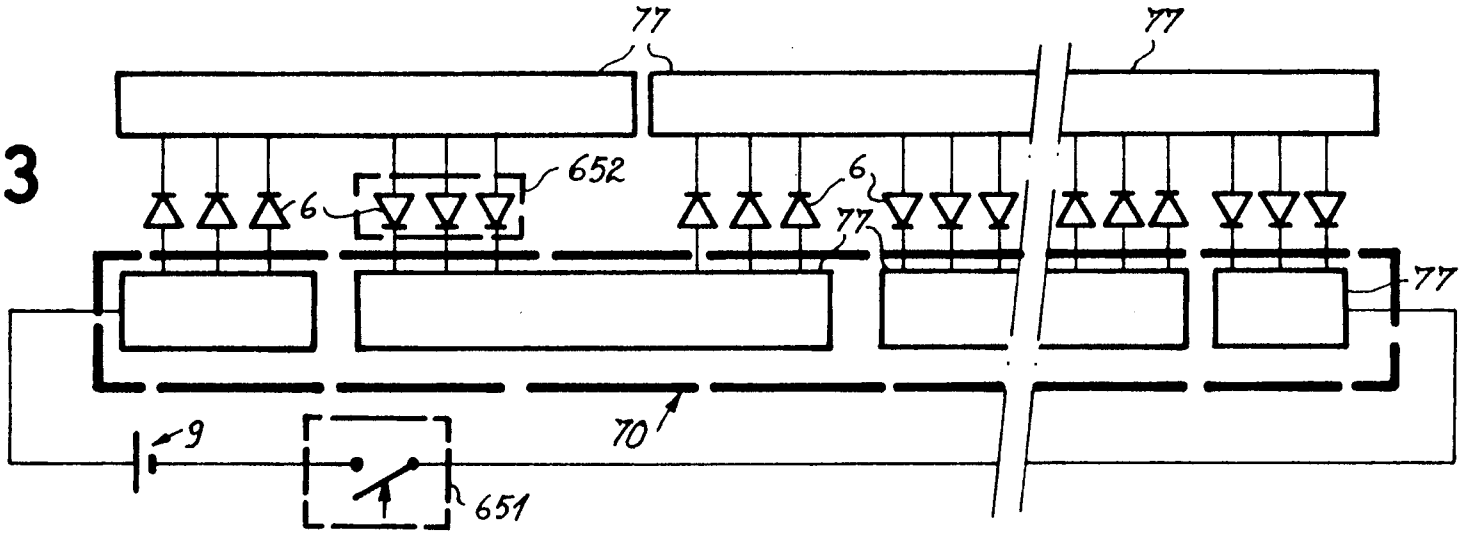
FIG. 13 is a front view of one emboidment of the device of the invention.

In FIG. 13, a variant of construction of the wiring of the array of the invention is shown. In FIGS. 3, 6, 8 and 9 all the diodes 6 connecting two metal strips 70 together are connected in parallel.

Thus, a short circuit caused by the failure of any one of diodes 6 connecting together two metal strips 70 places said strips permanently at the same potential. In such a case, control of the phase shift introduced by said metallized strips 70 is lost over the whole of their length. Formation of the electromagnetic energy beam is very greatly disturbed thereby. The failure of a diode 6 may be the consequence of a manufacturing defect. In such a case, it is possible to prevent the short circuit by destroying the defective diode 6 for example with a laser. However, it is necessary to have considerable test equipment.

But the failure of a diode 6 may also appear during use. In this case, the operation of the device is disturbed until the failure has been corrected.

In the device of the invention illustrated in FIG. 13, the metal strips 70 are cut up into a plurality of segments 77.

Segments 77 are connected together in groups 652 of diodes 6. Each group of diodes includes for example between 1 and 6 diodes, placed in parallel. In the example illustrated in FIG. 13, each group 653 of diode 6 includes three diodes 6. All the diodes 6 belonging to the same group have the same bias.

The successive groups of diodes 6 are connected in series as seen in FIG. 14. It is possible to connect the segments 77 together by forwardly biasing the diodes 6 or to isolate them by reversely biasing the diodes 6. In FIG. 13, the generator bears the reference 9 and the switching means the reference 651.

In FIG. 14, the electric diagram is shown of the connections of the diode 6 of FIG. 13. In the example illustrated in FIG. 14, the groups 652 of three diodes 6 placed in parallel are connected in series. A short circuit at the level of the diode 6 prevents the phase control at the level of a group 652 of diode 6, but not of two metal strips 70. An absence of electric continuity at the level of a diode 6, for example following a manufacturing defect or a "breakdown" only disturbs the phase locally at the level of two segments 77. All the groups 652 of diodes 6 are fed by the other diodes 6 of the group 652 including the "brokendown" diode 6.

The voltage power supply is provided between terminals 78 and 79 of the periodic circuit.

Figure 20:
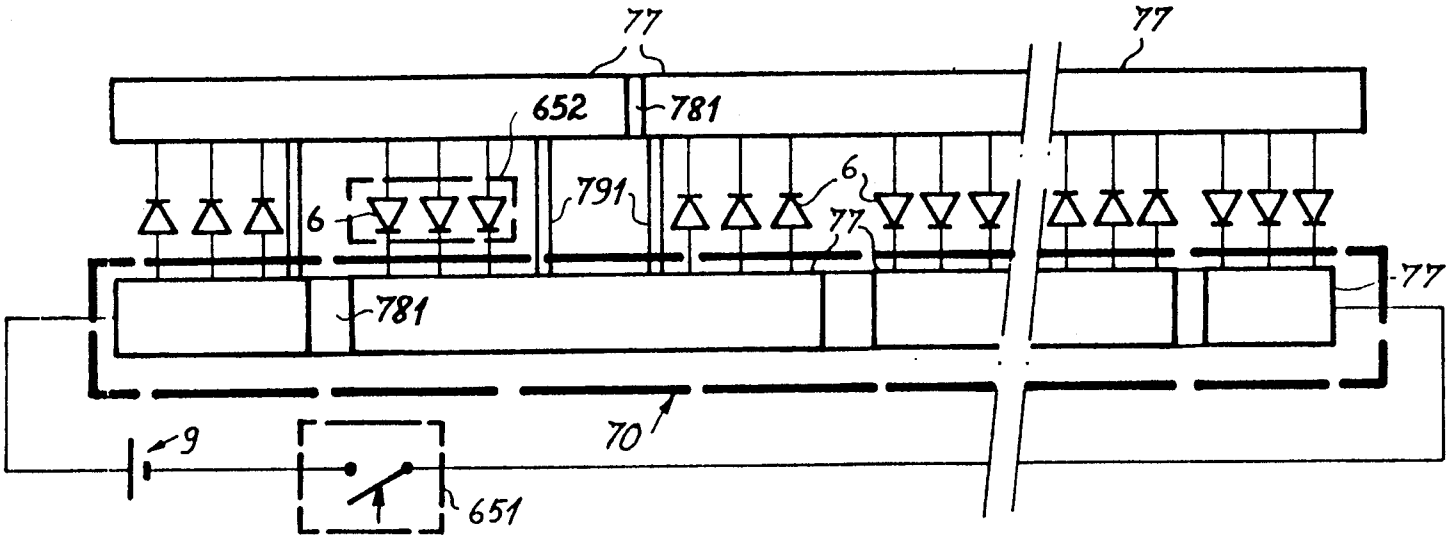
FIG. 20 is a front view of one embodiment of the device of the invention.

In FIG. 20, a variant of construction of the device shown in FIG. 13, can be seen in which the reverse voltages at the terminals of the group 652 of diodes 6 placed in series are balanced. The balancing is obtained for example, by connecting two successive segments 77 together by resistors 791 and/or by connecting together the successive segments 77 belonging to the same metal strip 70 by resistors 781.

Resistors 781 and 791 have high values so as not to disturb the radioelectric operation.

Advantageously, resistors 781 and/or 791 are obtained by metallization. For example, a resistive nickel chromium alloy is deposited.

In a variant of construction, resistors 781 are deposited in the extension of segments 77. Resistors 791 are for example ribbons of small thickness.

Figure 21:
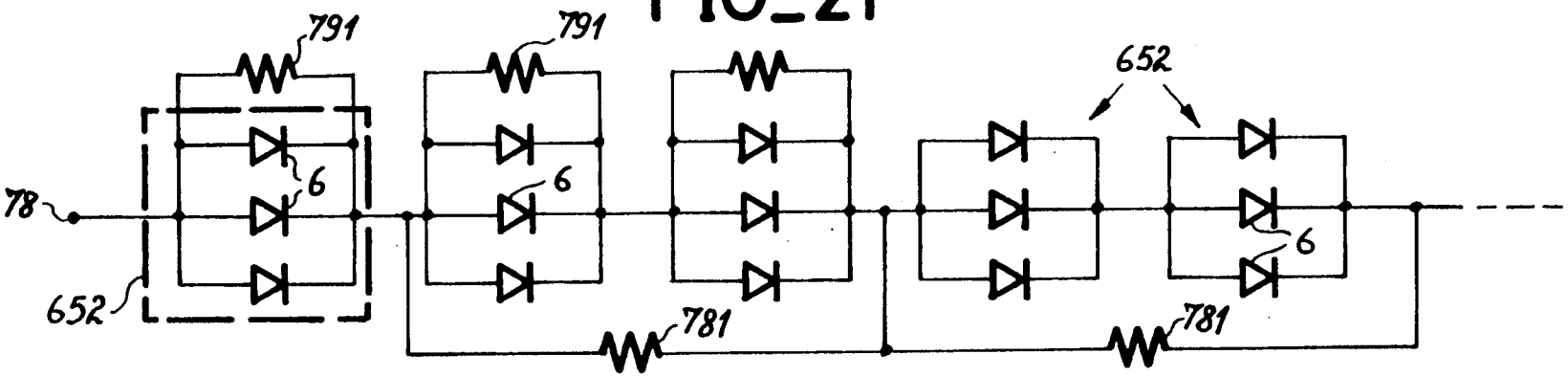
FIG. 21 is the equivalent diagram of the power supply for the diodes of the device illustrated in FIG. 20.

In FIG. 21 is shown the wiring diagram of the connections of diodes 6 and resistors 781 and 791 of FIG. 20.

The first group 652 of diodes 6 from terminal 78 illustrates the variant comprising solely resistors 791 connecting together two successive segments, 77.

The second and third groups 652 of diodes 6 illustrate the variant of construction including resistors 791 connecting together two successive segments 77 and resistors 781 connecting together two successive segments 77 belonging to the same metal strip 70.

The fourth and fifth groups 652 of diodes 6 illustrate the variant of construction having solely resistors 781 connecting together two successive segments 77 belonging to the same metal strip 70.

Figure 15:
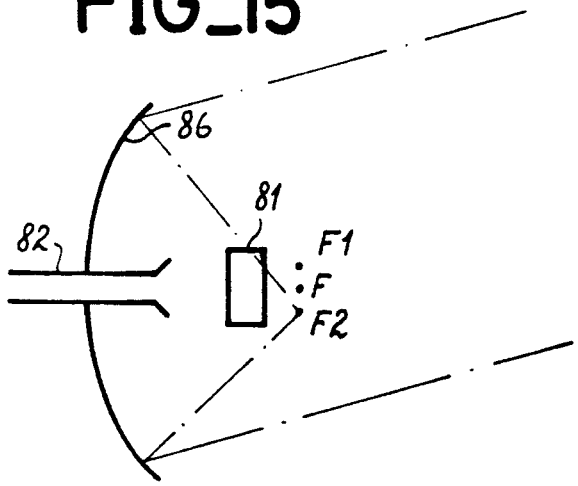
FIG. 15 is a sectional view of the third embodiment of the antenna of the invention.

In FIG. 15, can be seen an antenna in accordance with the invention particularly well adapted to tracking. The antenna has a source of radiation 82, an auxiliary reflector array 81 and a main mirror 86.

The radiation source 82 is for example a horn.

The auxiliary reflector array 81 is a phased reflector array in accordance with the invention.

Advantageously, array 81 provides electronic sweeping in both planes.

The main mirror is for example a paraboloid with focus F.

The deflection of the electromagnetic energy beam by array 81 causes a movement of the focus F or a movement of the equivalent center of source 82, for example to $F_1$ or $F_2$. The periodic movement of focus F, by scanning, provides tracking of the tarket.

Figure 19:
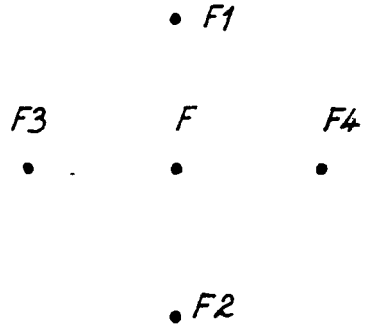
FIG. 19 is a diagram illustrating the positions of the focal point of the main mirror of the antenna ilustrated in FIG. 15.

Advantageously, as illustrated in FIG. 19, the focus is moved between four positions $F_1$, $F_2$, $F_3$, $F_4$, equidistant from F, points $F_1$ and $F_2$ on the one hand and points $F_3$ and $F_4$ on the other being aligned along orthogonal straight lines intersecting F.

Advantageously, a circular permutation or path of the movements of focus F is provided, for example $F_1$, $F_4$, $F_2$, $F_3$, $F_1$, . . . Of course, the use of a different number of positions Fi, for example 8, 16 or 32 does not depart from the scope or spirit of the invention. Points Fi are for example spaced apart evenly over a circle with center F.

Figure 16:
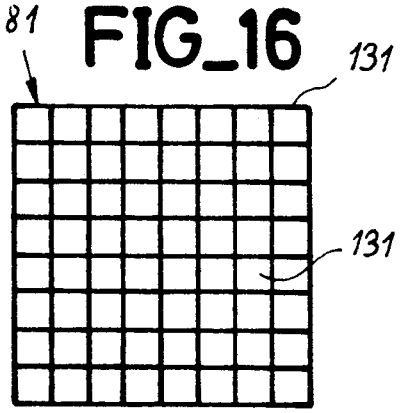
FIG. 16 is a front view of a first embodiment of a reflector array used in the antenna illustrated in FIG. 15.

In FIG. 16 a first embodiment of the phased array 81 of FIG. 15 can be seen. Array 81 includes cells 131 periodically spaced apart over its surface. The phase of each cell 131 is individually controllable. Cells 131 are for example triangular, square of hexagonal.

A conical scan of average precision may be obtained with a small number of cells 131, for example 64 ($8\times8$). an increase in precision of the scanning will be obtained with an increase in the number of cells 131.

Figure 17:
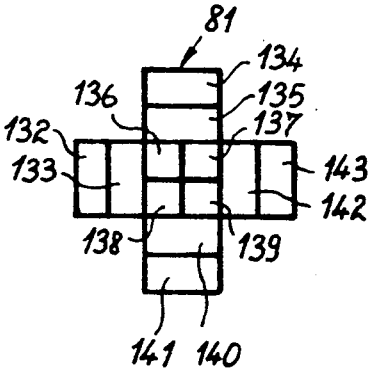
FIG. 17 is a front view of a second embodiment of a reflector array used in the antenna illustrated in FIG. 15.
Figure 18:
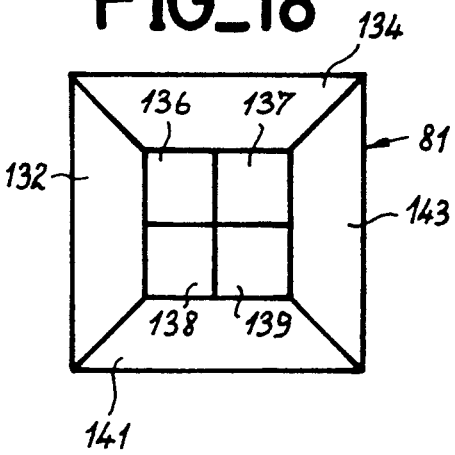
FIG. 18 is a front view of a third embodiment of a reflector array used in the antenna illustrated in FIG. 15.

In FIGS. 17 and 18 can be seen a second and third embodiment of array 81.

The arrays 81 of FIGS. 17 and 18 are particularly well adapted to conical scanning using four positions $F_1$, $F_2$, $F_3$, and $F_4$ of focus F illustrated in FIG. 19. Array 81 of FIG. 17 has the shape of a cross.

Array 81 of FIG. 17 includes four central cells 136 to 139, four intermediate cells 133, 135, 140 and 142 as well as four peripheral cells 132, 134, 141 and 143.

Cells 136 to 139 are square.

Cells 132, 133, 134, 135, 140, 141, 142 and 143 are rectangular; the area of each of these cells corresponds to that of two juxtaposed square cells.

For moving the focus F of the main mirror 86 of FIG. 15 to $F_3$:

cells 134, 135, 140 and 141 induce no phase shift;
cell 132 induces a phase shift of $\phi$
cell 133 induces a phase shift of $$\frac{3\phi}{5}$$

cells 136 and 138 induce a phase shift of $\phi/5$
cells 137 and 139 induce a phase shift of $\phi/5$
cell 142 induces a phase shift of $$-\frac{3\phi}{5}$$

cell 143 induces a phase shift of $-\phi$

For moving the focus F of the main mirror 86 of FIG. 15 to $F_1$:

cells 132, 133, 142, 143 induce no phase shift,
cell 134 induces a phase shift of $\phi$
cell 135 induces a phase shift of $$\frac{3\phi}{5}$$

cells 136 and 137 induce a phase shift of $\phi/5$
cells 138 and 139 induce a phase shift of $-\phi/5$
cell 140 induces a phase shift of $$-\frac{3\phi}{5}$$

cell 141 induces a phase shift of $-\phi$

For moving the focus F of the main mirror 86 of FIG. 15 to $F_4$:

cells 134, 135, 140 and 141 induce no phase shift;
cell 143 induces a phase shift of $\phi$
cell 142 induces a phase shift of $$\frac{3\phi}{5}$$

cells 137 and 139 induce a phase shift of $\phi/5$
cells 136 and 138 induce a phase shift of $-\phi/5$
cell 133 induces a phase shift of $$-\frac{3\phi}{5}$$

cell 132 induces a phase shift of $-\phi$

For moving the focus F of a main mirror 86 of FIG. 15 to $F_2$:

cells 132, 133, 142 and 143 induce no phase shift
cell 141 induces a phase shift of $\phi$
cell 140 induces a phase shift of $$\frac{3\phi}{5}$$

cells 138 and 139 induce a phase shift of $\phi/5$
cells 136 and 137 induce a phase shift of $-\phi/5$
cell 135 induces a phase shift of $-$ $$-\frac{3\phi}{5}$$

cell 134 induces a phase shift of $-\phi$

In FIG. 18 is shown a square array 81. Array 81 includes four central square cells 136 to 139 and four peripheral trapezoidal cells 132, 134, 141 and 143.

To move the focus F of the main mirror 86 of FIG. 15 to $F_3$:
cells 134 and 141 induce no phase shift
cell 132 induces a phase shift of $\phi$
cells 136 and 138 induce a phase shift of $\phi/3$
cells 137 and 139, induce a phase shift of $-\phi/3$
cell 143 induces a phase shift of $-\phi$ To move the focus F of the main mirror 86 of FIG. 15 to $F_1$:
cells 132 and 143 induce no phase shift
cell 134 induces a phase shift of $\phi$
cells 136 and 137 induce a phase shift of $\phi/3$
cells 138 and 139 induce a phase shift of $-\phi/3$
cell 141 induces a phase shift of $-\phi$ To move the focus of the main mirror 86 of FIG. 15 to $F_4$:
cells 134 and 141 induce no phase shift
cell 143 induces a phase shift of $\phi$
cells 137 and 139 induces a phase shift of $\phi/3$
cells 136 and 138 induce a phase shift of $-\phi/3$
cell 132 induces a phase shift of $\phi$ To move the focus F of the main mirror 86 of FIG. 15 to $F_2$:
cell 141 induces a phase shift of $\phi$
cells 138 and 139 induce a phase shift of $\phi/3$
cells 136 and 137 induce a phase shift of $-\phi/3$
cell 134 induces a phase shift of $-\phi$ The invention applies mainly to the construction of electronic scan antenna particularly in millimetric waves.

The invention applies mainly to the construction of antenna having phased reflector arrays.

The invention also applies to the construction of phase modulation panels for responder becons in cooperative radar systems or localization systems.

What is claimed is:

1. Apparatus for intercepting incident electromagnetic wave energy with a given wavelength and reflecting such wave energy with a controlled direction, comprising conductive means for forming a ground plane, a semiconductive wafer having a front and a back surface supported on the ground plane with its back surface adjacent the conductive means, an array of separate dipoles each having two legs and arranged on said front surface along regularly spaced rows and columns, the legs of each dipole being parallel to said columns and the distance between adjacent rows and between adjacent columns being of the order of half said wavelength, a plurality of conductive strips disposed on said front surface of the semiconductive wafer and parallel to said rows, one of the two legs of each of the dipoles aligned along a given row being electrically connected to one another by one of said strips and formed in said one strip, the other of the legs of each of said dipoles aligned along said given row being electrically connected to one another by an adjacent strip and formed in said adjacent strip, a plurality of junction diodes, at least one being connected between the two legs of each separate dipole, and biasing means, connected to each of said diodes through said conductive strips, for applying to said diodes a biasing voltage for controlling the reactive impedance of said diodes between a short-circuit value and a value matched to said incident electromagnetic wave energy, thereby controlling the amount of said incident electromagnetic wave energy reflected by the respective dipole associated with a respective diode from a maximal value to a minimal value, respectively, the portion of the incident electromagnetic wave energy not reflected by said respective dipole being transmitted to the ground plane and then reflected by said ground plane after impinging it, the portion of the incident electromagnetic energy reflected by said respective dipole and the portion thereof reflected by said ground plane combining together in an electromagnetic wave locally exhibiting a controlled variable phase shift depending on the relative amount of the respectively reflected portions.

2. Apparatus in accordance with claim 1 in which the junction diodes are PIN diodes formed by localized p-type and n-type regions in the semiconductive wafer.

3. Apparatus in accordance with claim 1 in which the conductive strips are spaced from the ground plane about a quarter wave length of the wave length of the electromagnetic wave energy.

4. Apparatus as in claim 1 in which the conductive means forming the ground plane is on the back surface of the semiconductive wafer.

5. Apparatus as in claim 1 wherein there is included dielectric material between the back surface of the semiconductive wafer and the conductive means forming the ground plane.

6. Apparatus in accordance with claim 1 in which each of the conductive strips is divided into segments and adjacent segments of each strip are interconnected by resistive means deposited on said semiconductive wafer.

7. Apparatus for intercepting incident electromagnetic wave energy with a given wavelength reflecting such wave energy with a controlled direction, comprising conductive means for forming a ground plane, a semiconductive wafer having a front and a back surface supported on the ground plane with its back surface adjacent the conductive means, an array of separate dipoles each having two legs and arranged on said front surface along regularly spaced rows and columns, the legs of each dipole being parallel to said columns and the distance between adjacent rows and between adjacent columns being of the order of half said wavelength, a plurality of conductive strips disposed on said front surface of the semiconductive wafer and parallel to said rows, one of the two legs of certain groups of the dipoles aligned along a given row being electrically connected to certain groups of the dipoles by one of said strips and formed in said one strip, the other of the legs of certain groups of said dipoles aligned along said given row being electrically connected to certain groups of the dipoles by an adjacent strip and formed in said adjacent strip, a plurality of junction diodes, at least one being connected between the two legs of each separate dipole, and biasing means, connected to each of said diodes through said conductive strips, for applying to said diodes a biasing voltage for controlling the reactive impedance of said diodes between a short-circuit value and a value matched to said incident electromagnetic wave energy, thereby controlling the amount of said incident electromagnetic wave energy reflected by the respective dipole associated with a respective diode from a maximal value to a minimal value, respectively, the portion of the incident electromagnetic wave energy not reflected by said respective dipole being transmitted to the ground plane and then reflected by said ground plane after impinging it, the portion of the incident electromagnetic energy reflected by said respective dipole and the portion thereof reflected by said ground plane combining together in an electromagnetic wave locally exhibiting a controlled variable phase shift depending on the relative amount of the respectively reflected portions wherein each of said conductive strips is divided into a plurality of discrete segments so that the diodes may be biased whereby the direction of the radiated electromagnetic wave energy may be controlled.

8. Apparatus for intercepting incident electromagnetic wave energy with a given wavelength and reflecting such wave energy with a controlled direction, comprising conductive means for forming a ground plane, a semiconductive wafer having a front and a front and back surface supported on the ground plane with its back surface adjacent the conductive means, an array of separate dipoles each having two legs and arranged on said front surface along regularly spaced rows and columns, the legs of each dipole being parallel to said columns and the distance between adjacent rows and between adjacent columns being of the order of half said wavelength, a plurality of conductive strips disposed on said front surface of the semiconductive wafer and parallel to said rows, one of the two legs of certain groups each of the dipoles aligned along a given row being electrically connected to certain groups of the dipoles by one of said strips and formed in said one strip, the other of the legs of certain groups of said dipoles aligned along said given row being electrically connected to certain groups of the dipoles by an adjacent strip and formed in said adjacent strip, a plurality of junction diodes, at least one being connected between the two legs of each separate dipole, and biasing means, connected to each of said diodes through said conductive strips, for applying to said diodes a biasing voltage for controlling the reactive impedance of said diodes between a short-circuit value and a value matched to said incident electromagnetic wave energy thereby controlling the amount of said incident electromagnetic wave energy reflected by the respective dipole associated with a respective diode from a maximal value to a minimal value, respectively, the portion of the incident electromagnetic wave energy not reflected by said respective dipole being transmitted to the ground plane and then reflected by said ground plane after impinging it, the portion of the incident electromagnetic energy reflected by said respective dipole and the portion thereof reflected by said ground plane combining together in an electromagnetic wave locally exhibiting a controlled, variable phase shift depending on the relative amount of the respectively reflected portions, in which each of the plurality of conductive strips is divided into discrete segments and segments of adjacent pairs of said strips are connected in series by diodes.

9. Apparatus for intercepting incident electromagnetic wave energy with a given wavelength and reflecting such wave energy with a controlled direction, comprising conductive means for forming a ground plane, a semiconductive wafer having a front and a back surface supported on the ground plane with its back surface adjacent the conductive means, an array of separate dipoles each having two legs and arranged on said front surface along regularly spaced rows and columns, the legs of each dipole being parallel to said columns and the distance between adjacent rows and between adjacent columns being of the order of half said wavelength, a plurality of conductive strips disposed on said front surface of the semiconductive wafer and parallel to said rows, one of the two legs of certain groups of the dipoles aligned along a given row being electrically connected to certain groups of the dipoles by one of said strips and formed in said one strip, the other of the legs of certain groups of said dipoles aligned along said given row being electrically connected to certain groups of the dipoles by an adjacent strip and formed in said adjacent strip, a plurality of junction diodes, at least one being connected between the two legs of each separate dipole, and biasing means, connected to each of said diodes through said conductive strip, for applying to said diodes a biasing voltage for controlling the reactive impedance of said diodes between a short-circuit value and a value matched to said incident electromagnetic wave energy, thereby controlling the amount of said incident electromagnetic wave energy reflected by the respective dipole associated with a respective from a maximal value to a minimal value, respectively, the portion of the incident electromagnetic wave energy not reflected by said respective dipole being transmitted to the ground plane and then reflected by said ground plane after impinging it the portion of the incident electromagnetic energy reflected by said respective dipole and the portion thereof reflected by said ground plane combining together in an electromagnetic wave locally exhibiting a controlled variable phase shift depending on the relative amount of the respectively reflected portions, in which each of the plurality of conductive strips is divided into discrete segments and segments of adjacent pairs of said strips are interconnected by groups of diodes in parallel.

10. An antenna comprising a primary radiation source with a given wavelength, and a reflector in the path of the radiation from said source for redirecting the radiation, said reflector comprising conductive means forming a ground plane, a semiconductive wafer having front and back surfaces, said back surface being supported on the ground plane, an array of separate dipoles each having two legs and arranged on said front surface along regularly spaced rows and columns, the legs of each dipole being parallel to asid columns and the distance between adjacent rows and between adjacent columns being of the order of half said wavelength, a plurality of conductive strips disposed on said front surface of the semiconductive wafer and parallel to said rows, one of the two legs of each of the dipoles aligned along a given row being electrically connected to one another by one of said strips and formed in said one strip, the other of the legs of each of said dipoles aligned along said given row being electrically connected to one another by an adjacent strip and formed in said adjacent strip.

a plurality of junction diodes, at least one being connected between the two legs of each separate dipole and biasing means, connected to each of said diodes through said conductive strips, for applying to said diodes a biasing voltage for controlling the reactive impedance of said diodes between a short-circuit value and a value matched to said radiation thereby controlling the amount of said radiation reflected by the respective dipole associated with a respective diode from a maximal value to a minimal value, respectively, the portion of the radiation not reflected by said respective dipole being transmitted to the ground plane and then reflected by said ground plane after impinging it, the portion of the radiation reflected by said respective dipole and the portion thereof reflected by said ground plane combining together in an electromagnetic wave locally exhibiting a controlled, variable phase shift depending on the relative amount of the respectively reflected portions.

11. An antenna as in claim 10 that also includes a dielectric lens for focussing said radiation.

12. An antenna having a radiation source with a given wavelength, a main mirror, and phased array apparatus for varying the position of focus of the main mirror comprising conductive means forming a ground plane, a semiconductive wafer having front and back surfaces, said back surface being supported on the ground plane, an array of separate dipoles each having two legs and arranged on said front surface along regularly spaced rows and columns, the legs of each dipole being parallel to said columns and the distance between adjacent rows and between adjacent columns being of the order of half said wavelength.

a plurality of conductive strips disposed on said front surface of the semiconductive wafer and parallel to said rows, one of the two legs of each of the dipoles aligned along a given row being electrically connected to one another by one of said strips and formed in said one strip, the other of the legs of each of said dipoles aligned along said given row being electrically connected to one another by an adjacent strip and formed in said adjacent strip.

a plurality of junction diodes at least one being connected between the two legs of each separate dipole, and biasing means, connected to each of said diodes through said conductive strips, for applying to said diodes a biasing voltage for controlling the reactive impedance of said diodes between a short-circuit value and a value matched to incident electromagnetic wave energy thereby controlling the amount of said incident electromagnetic wave energy reflected by the respective dipole associated with a respective diode from a maximal value to a minimal value, respectively, the portion of the incident electromagnetic wave energy not reflected by said respective dipole being transmitted to the ground plane and then reflected by said ground plane after impinging it, the portion of the incident electromagnetic energy reflected by said respective dipole and the portion thereof reflected by said ground plane combining together in an electromagnetic wave locally exhibiting a controlled, variable phase shift depending on the relative amount of the respectively reflected portions.

13. An antenna as in claim 12 wherein said biasing means biases the diodes to vary the focus along a circular path.

14. Apparatus in accordance with claim 12 in which the dipoles are sized and spaced for operation with millimeter waves.

* * * * *